US005279024A

United States Patent [19]

Zieve et al.

[11] Patent Number: 5,279,024

[45] Date of Patent: Jan. 18, 1994

[54] APPARATUS AND METHOD TO PREVENT RIVET SHANKING

[75] Inventors: Peter B. Zieve; John L. Hartmann, both of Seattle, Wash.

[73] Assignee: Electroimpact, Inc., Seattle, Wash.

[21] Appl. No.: 4,230

[22] Filed: Jan. 12, 1993

Related U.S. Application Data

[63] Continuation of Ser. No. 755,828, Sep. 6, 1991, abandoned.

[51] Int. Cl.[5] ..... B21D 39/00; B23P 11/02

[52] U.S. Cl. ..... 29/243.53; 29/243.54; 227/51

[58] Field of Search ..... 29/525.2, 524.1, 243.53, 29/243.54; 227/51, 61, 62

[56] References Cited

U.S. PATENT DOCUMENTS

| | | | |
|---|---|---|---|
| 3,557,442 | 1/1971 | Speller | 29/243.53 |
| 3,952,401 | 4/1976 | Wagner | 29/524.1 |
| 4,749,323 | 6/1988 | Sparling et al. | 29/524.1 X |
| 4,864,713 | 9/1989 | Roberts et al. | 29/524.1 |
| 5,050,284 | 9/1991 | Howard et al. | 29/243.54 |

FOREIGN PATENT DOCUMENTS

| | | | |
|---|---|---|---|
| 647202 | 11/1928 | France | 29/243.53 |

*Primary Examiner*—Joseph M. Gorski
*Attorney, Agent, or Firm*—Jensen & Puntigam

[57] ABSTRACT

The apparatus includes a riveting assembly (10) which includes a rivet die (18) having a concave configuration which is brought into contact with one end of a rivet to be upset. The die (18) is driven into a rivet end by a rivet ram (16) a first time, resulting in an interference fit between the rivet shank and the part being riveted. When the die (18) is withdrawn, the newly formed rivet head will in some instances expand outwardly away from the surface of the part, leaving a gap between the formed end of the rivet and the part. A second strike assembly includes an L-shaped second strike element (28) which is moved between the die (18) and the rivet head. The ram (16) is then driven a second time, forcing the second strike element (28) against the formed end of the rivet, forcing the formed end of the rivet to flow outwardly and toward the part, resulting in the filling of the gap between the rivet head and the surface of the part.

13 Claims, 4 Drawing Sheets

APPARATUS AND METHOD TO PREVENT RIVET SHANKING

This is a continuation of application Ser. No. 755,828, filed on Sep. 6, 1991, and now abandoned.

TECHNICAL FIELD

This invention relates generally to the art of riveting apparatus and more specifically concerns a riveting apparatus designed to prevent rivet shanking (head-gapping) during rivet installation.

BACKGROUND OF THE INVENTION

Fatigue life has always been a significant concern with respect to rivets in high performance applications, such as on an aircraft. It is known that fatigue life can be increased for aircraft applications, often significantly, by an interference fit between the rivet and the particular aircraft part in which the rivet is installed. An interference fit is obtained with a rivet which is initially somewhat smaller than the diameter of the opening in the aircraft part hole and requires significant opposing pressure during rivet installation in the axial dimension of the rivet, i.e. longitudinally of the rivet, and with specially shaped rivet die at each end of the rivet. The dies are positioned on the ends of opposing rivet rams which produce the rivet upset. The interference fit results in the diameter of the opening in the aircraft part being slightly increased, with the aircraft part material in the vicinity of the hole being maintained in a state of compression which in turn results in an enhanced fatigue life.

One undesirable consequence of an interference fit, particularly when automatic riveting machines are used, is the phenomenon known as rivet shanking, also referred to as "head-gapping". Rivet shanking occurs when the rivet forming die on the end of the ram is moved away from the head of a rivet after the rivet has been installed. The head of the rivet will, under certain conditions, move or rebound slightly away from the surface of the part once the forming die is withdrawn, leaving a space (a gap) between the underside of the rivet head and the part surface. The gap distance, i.e. the distance between the underside of the rivet head and the aircraft part, will vary from rivet to rivet, but can exceed the maximum gap allowable by aircraft manufacturers, which is typically between 0.0015 and 0.0030 inches. This phenomenon is often referred to as rivet shanking because the shank of the rivet, which is the cylindrical portion thereof, is in the opening in the part and a rivet is rejected if the inspector can slide a feeler gauge of a particular thickness, such as 0.002, underneath the head of the rivet to contact the shank.

Typically, the tendency toward shanking is increased when the ratio of rivet length to rivet diameter is relatively large. Further, the newer aluminum alloys used in aircraft, while possessing higher strength, are also more elastic, resulting in an increase in shanking.

There have been many different attempts, several quite sophisticated and complex, to solve the rivet shanking problem. However, to date, no method has been particularly successful.

DISCLOSURE OF THE INVENTION

Accordingly, the present invention is an apparatus for control of rivet shanking which comprises: means for forming a rivet in a part, such as an aircraft part, including a rivet ram, a rivet die which is in alignment with one end of the rivet, and means for driving the rivet ram forward toward the rivet a first time, producing a formed end of the rivet; means for withdrawing the rivet ram and the die from the rivet; means for moving a second strike element between the die and the formed end of the rivet; and means for driving the rivet ram forward a second time, with the second strike element engaging the formed end of the rivet, resulting in a flow of the formed end of the rivet, substantially filling any gap between the formed end of the rivet and the part resulting from the first driving of the rivet ram.

The invention also includes a corresponding method and, alternatively, includes a second rivet ram with a second die which takes the place of the second strike element. The second rivet ram with the second die is moved into alignment with the rivet after the first rivet ram has been driven forward and then withdrawn.

BEST MODE FOR CARRYING OUT THE INVENTION

Figure 1:
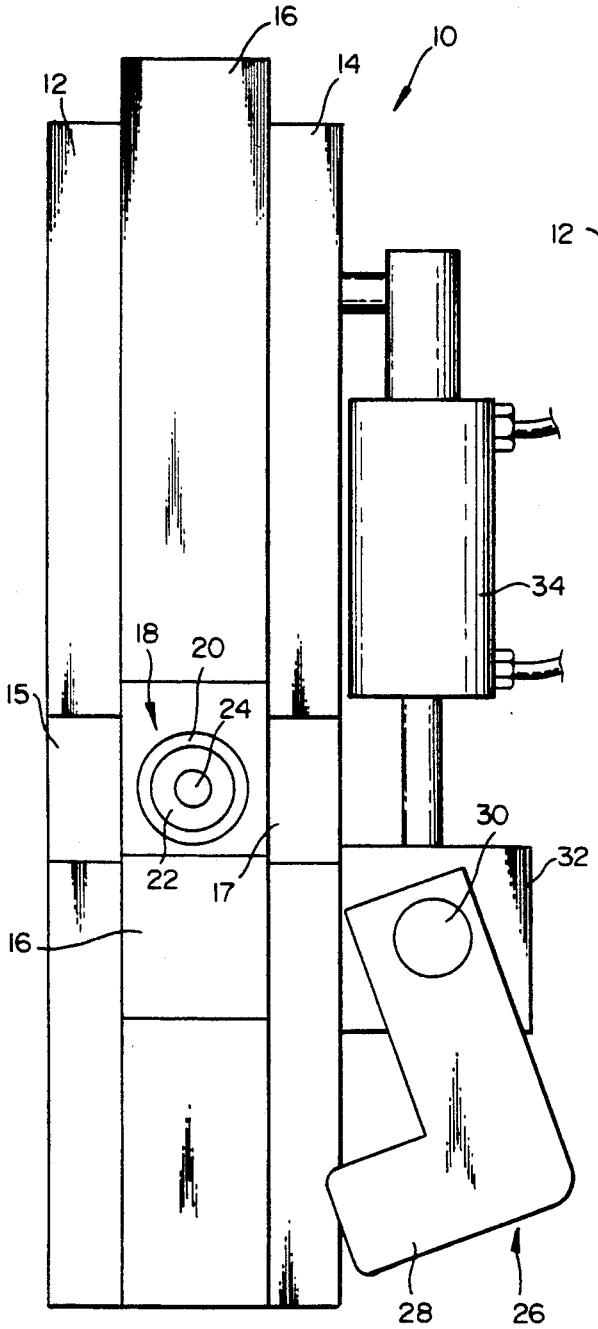
FIG. 1 is a front elevational view showing the apparatus of the present invention in a first position.
Figure 2:
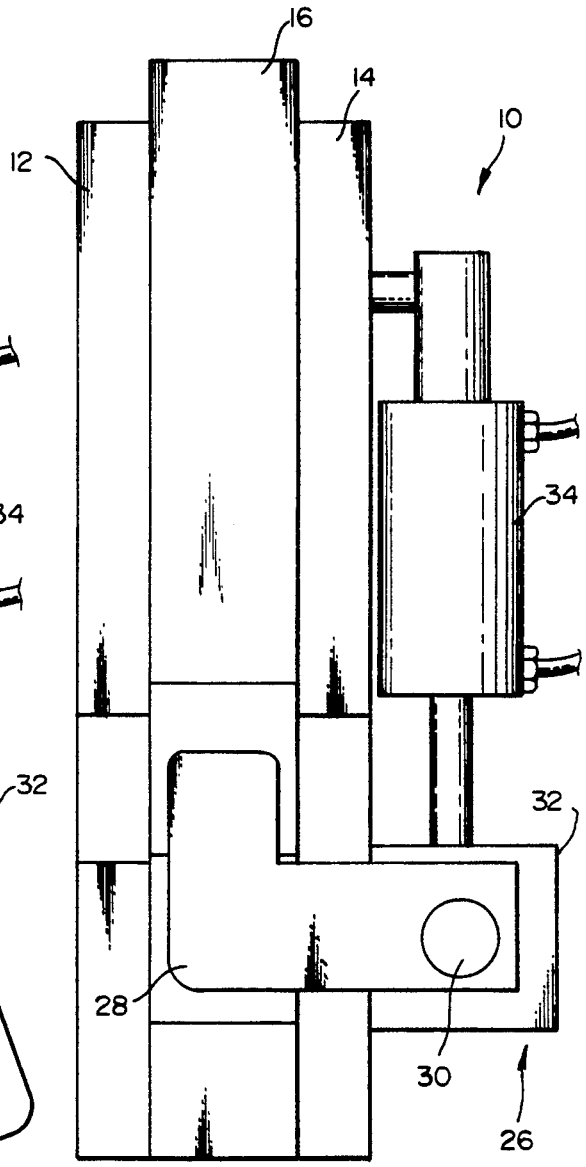
FIG. 2 is a front elevational view showing the apparatus of FIG. 1 in a second position.
Figure 3:
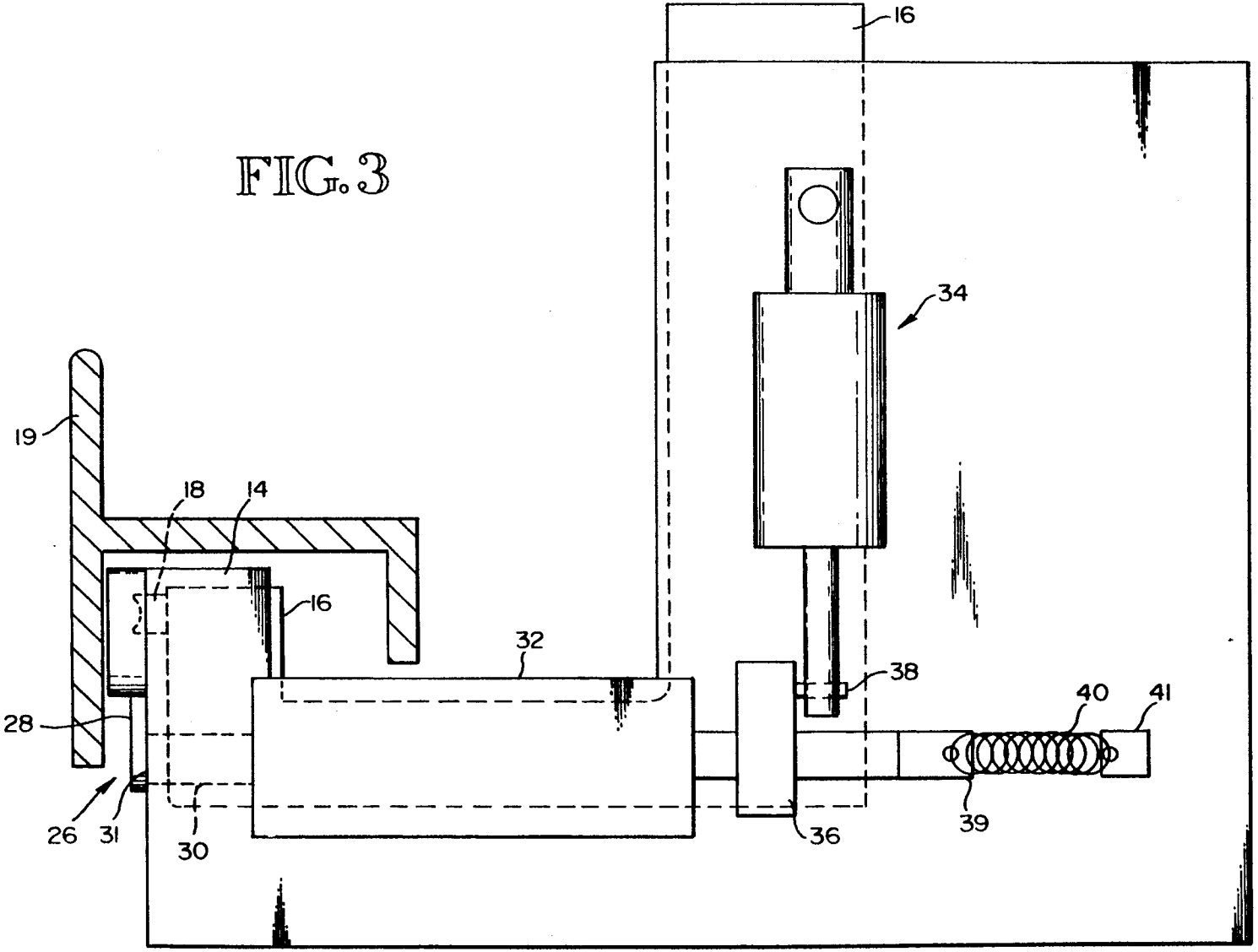
FIG. 3 is a side elevational view of the apparatus of FIG. 1.

Referring now to FIGS. 1 through 3, the apparatus of the present invention is shown generally at 10. The present invention is used in conjunction with a conventional automatic riveting apparatus which is not shown in detail. FIGS. 1 through 3 show the present invention configured for riveting on the particular part shown. This is known as an offset configuration. It should be understood that the invention is equally applicable for straight riveting. Also, in FIGS. 1 through 3, as described in detail below, only one side (one ram) of a complete riveting apparatus is shown. The present invention could also be used with rams on both sides of the part to be riveted. The apparatus shown in FIGS. 1 through 3 includes two clamp-up plates 12 and 14, from the front edge thereof extends clamp-up pads 15 and 17, which in operation contact the part 19 to be riveted. In the embodiment shown, part 19 has a configuration necessitating an offset riveting apparatus.

A ram element 16 is positioned between clamp-up plates 12 and 14 and is shown somewhat offset longitudinally for illustration. To the front end of ram 16 is secured a rivet-forming die 18, which includes a cup-like depression which is configured with a flat outer surface 20, a flat inner surface 24 and a circumferential wall 22 which angles inwardly between the outer and inner surfaces. It should be understood that the configuration of die 18 may vary from embodiment to embodiment, although typically it will have at least a slightly concave configuration. A die with such a configuration has the capability of containing the radial expansion of the head of the rivet and directing substantial force along the rivet shank, into the hole, i.e. the die "focuses" the riveting pressure into the opening in the part, in order to produce the desired interference fit between the rivet and the aircraft part.

In operation, the riveting ram element 16, including the die 18, will move forward with significant pressure (the clamp-up pads 15 and 17 in contact with the part) to upset the rivet, resulting in the formation of a rivet head by the shape of the die. During upset, it is desirable for the rivet to be compressed, producing in turn the desired compression of the material thereabout and an interference fit between the rivet and the part.

When the rivet ram, including the die, is withdrawn following completion of this initial riveting step, the now-formed rivet head springs back slightly, away from the surface of the part, in the direction of the die. This can result in a space between the underside of the rivet head and the part which exceeds that normally allowable (between 0.0015 and 0.0030 inches). This action is referred to as rivet shanking or head gapping, as explained above. Rivet shanking is undesirable and is not accepted by aircraft manufacturers.

The present invention comprises a second strike assembly, used in conjunction with the rivet ram 16. The second strike assembly is shown generally at 26 in FIGS. 1 through 3. It includes a double strike flat plate or flag 28, which in the embodiment shown, is made of high impact steel, approximately ⅛ inch thick. The double strike plate 28 is mounted on a shaft 30, which is in turn supported for rotation as described below. The double strike plate or flag 28 is L-shaped with a particular mounting arrangement in the embodiment shown. While in the embodiment shown, the double strike element 28 is flat, it may have other configurations, including slightly concave, convex, or even pointed, as long as the desired effect described below is achieved, Plate 28 has a first operating position in which die 18 has free access to the rivet. In a second position of plate 28, a portion of the plate is between die 18 and the rivet. The clamp-up pads 15, 17 are pressed against the part during riveting operations, and the part being riveted may prevent access from the top, so that the double strike plate must be moved into its second position from below the die. The L-shaped plate 28, rotated about one end, as shown, on shaft 30, is conveniently rotatable between the first position in which it is entirely out of the way of die 20 and the second position in which a portion of the plate extends through the riveting axis, between the die and the part. Shaft 30 extends parallel to ram 16, and hence is parallel to the longitudinal movement of rivet die 18. Double strike plate 28 is mounted on the forward end 31 of shaft 30 such that plate 28 moves in a plane which is perpendicular to the direction of movement of rivet die 18. Shaft 30 is generally supported by bearings (not shown) which are enclosed by a bearing housing shown at 32.

An actuator 34 is mounted on the rivet assembly and is connected to shaft 30 by means of a cam 36 and pin link shown at 38. Actuator 34 is designed so as to rotate shaft 30 in either rotational direction, as necessary. In the embodiment shown, actuator 34 is an air cylinder, but it could also be another actuator such as a motor or the like. The rear end 39 of the shaft 30 is connected through a spring 40 to a base element 41 on the rivet assembly. Hence, shaft 30 and double strike plate 28 are free to move to some extent longitudinally relative to the rivet assembly.

Figure 4A:
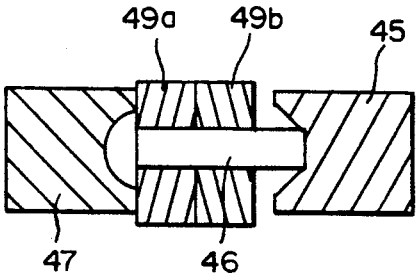
FIGS. 4A–4D are a series of simplified views showing the operational steps of the apparatus of the present invention.
Figure 4B:
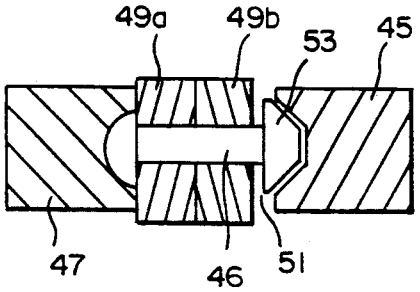

In operation, referring to FIGS. 4A–4D, cup die 45 will first be brought into contact with an extending end of rivet 46, as shown in FIG. 4A, which also shows a backing die 47 and the parts to be riveted, 49A and 49B. The rivet ram will then operate for the first time, in the direction of the arrow in FIG. 4A, forcing the die 45 against the rivet and forming a rivet head 53. The dies 45 and 47 are then withdrawn, allowing the rivet head to move away from the surface of part 49B. In FIGS. 4A–4D, a gap 51 (shown exaggerated for clarity) is shown only with respect to the head 53 of the rivet. It should be understood, however, that a gap could exist at the tail end as well.

Figure 4C:
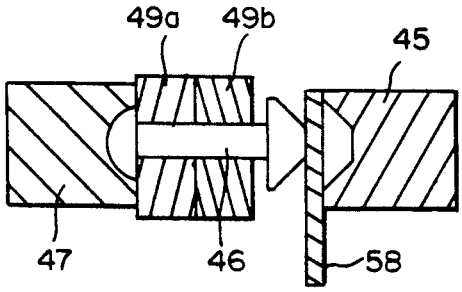
Figure 4D:
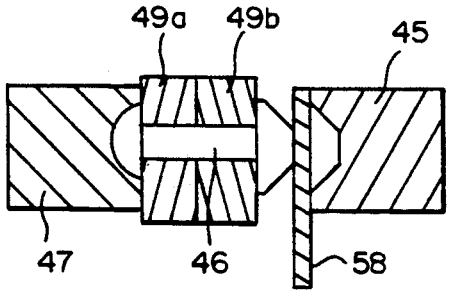

The air cylinder is then activated, rotating the L-shaped double strike plate 58 (FIGS. 4C–4D) approximately 90° to its second, elevated position, with a portion of plate 58 being directly in front of die 45, between die 45 and the head of the rivet. This is shown in FIG. 4C. Die 45 is then moved forward such that the rivet head, die 45 and the double strike plate 58 are in direct contact with each other. At this point, the rivet ram is again actuated, although with a force which is significantly less than that used for the first strike.

In the embodiment shown, the second strike force is approximately 20,000 pounds, while the first strike force is approximately 40,000 pounds, depending on the rivet size. The result of the second strike is that the head portion 53 of the rivet flows back to the surface of part 49B and radially outward. Shanking is eliminated to the extent that there is usually less than a 0.001 inch gap between the underside of the head of the rivet and the part. Only a small amount of force is imparted to the rivet shank, and hence only a very small amount of springback of the rivet shank results from the second strike. The plate 58 is then rotated back to its first position.

The invention has been described with respect to only one end of a rivet, i.e. the formed head end of a rivet. The invention can be used on both ends of a rivet when a gap occurs between the head and formed button ends of a rivet. A double strike assembly is used on both sides of the part in such a case. However, in the case of a slug rivet involving a counter sunk hole on one side, the shanking problem will often occur just on the button side, due to the anchoring capacity of the head. In this case, only one double strike assembly is required.

Figure 5A:
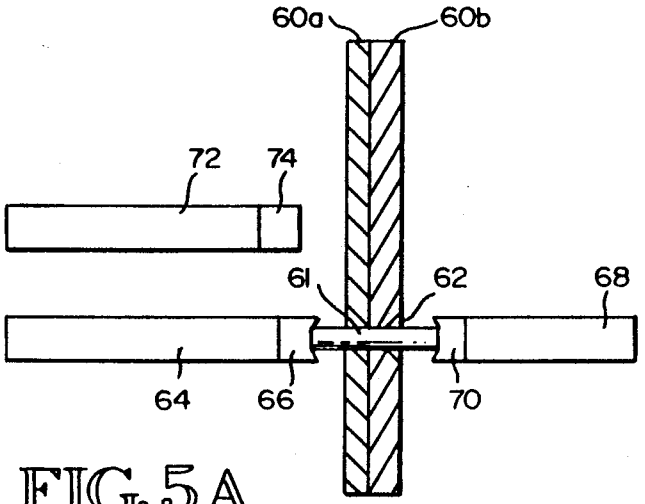
FIGS. 5A–5D are a series of simplified views showing the operational steps of an alternative embodiment of the apparatus of the present invention.
Figure 5B:
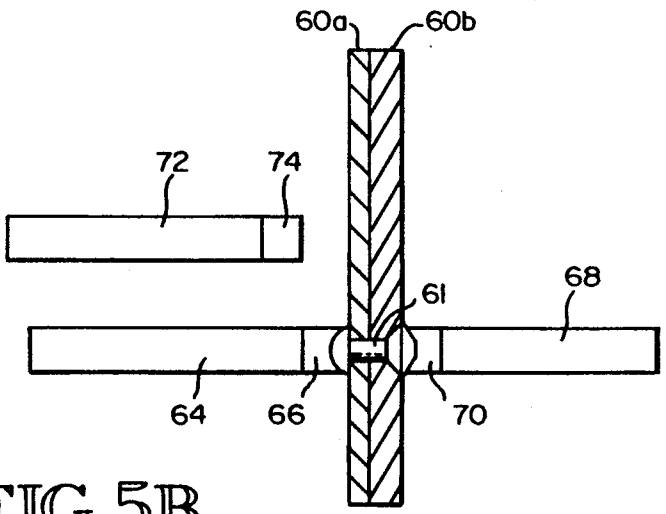
Figure 5C:
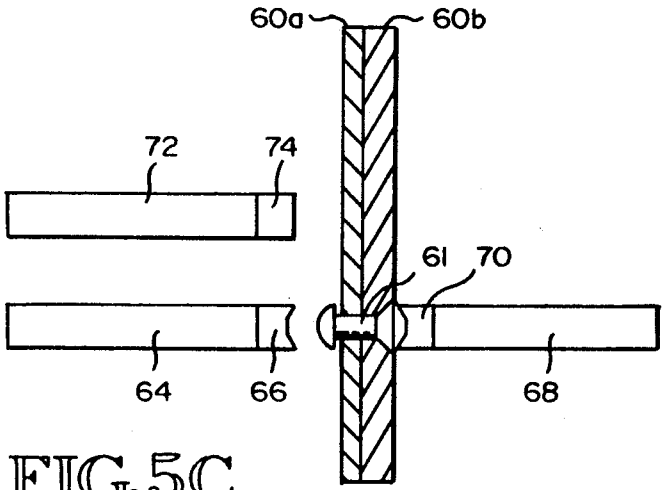
Figure 5D:
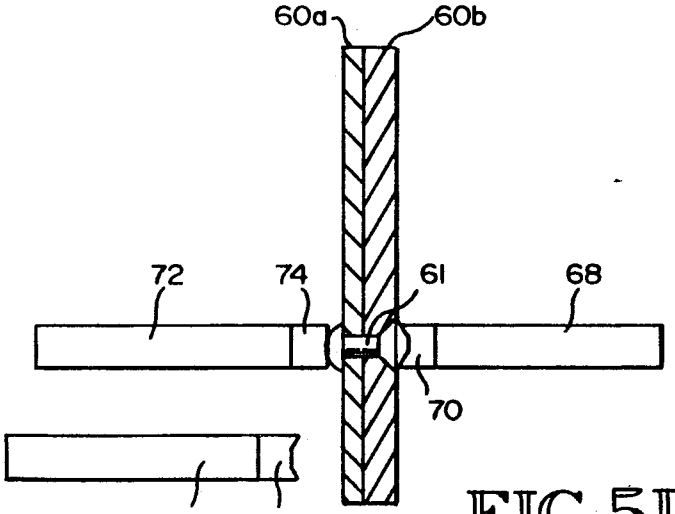

FIGS. 5A–5D illustrate another embodiment of the present invention. In this embodiment, the double strike plate is replaced by a second ram and die arrangement. FIG. 5A shows two parts 60A and 60B to be joined with a rivet 61, with part 60B having a countersunk opening 62 therein, a first front ram 64 with a concave die 66 and a rear ram 68 with a concave die 70. Second front ram 72 has a flat die 74 attached thereto. FIG. 5B shows the initially formed rivet, with a head on one side and a formed button on the countersunk side, using rams 64 and 68. FIG. 5C shows the shanking effect when ram 64 is moved away from the part. Then, ram 64 is moved away from the riveting axis and ram 72, with flat die 74, is moved into position by means of a shuttle or similar structure. Ram 72 is then moved forward, driving die 74 against the rivet head, producing a similar effect to that described above with respect to the double strike plate. This is shown in FIG. 5D.

It should be understood that the invention described above can be used with hydraulic, pneumatic and/or electromagnetic riveters and that it provides a relatively simple and inexpensive solution to a significant current problem in riveting operations. The apparatus may be supplied with conventional riveting machines or adapted to existing machines.

While a preferred embodiment has been described herein for purposes of illustration, it should be understood that modifications, substitutions and changes may be made to such embodiment without departing from the spirit of the invention which is defined by the claims which follow:

What is claimed is:

1. An apparatus for control of rivet shanking, comprising:

means for forming a rivet in a part, including a rivet ram, a rivet die positioned on the ram in alignment with one end of a rivet and means for driving the rivet ram forward at first and second times during a riveting operation and for withdrawing the rivet ram and the die between said first and second times, wherein driving the rivet ram forward said first time produces a formed end of the rivet;

a second strike element; and means for moving the second strike element between the die and the formed end of the rivet following withdrawal of the rivet ram and the die, wherein driving the rivet ram forward a second time results in the second strike element engaging the formed end of the rivet, resulting in a flow of the formed end of the rivet, substantially filling any gap between the formed end of the rivet and the part resulting from the first driving of the rivet ram.

2. An apparatus of claim 1, wherein the force of the second drive of the rivet ram is substantially less than the force of the first drive.

3. An apparatus of claim 1, wherein the rivet die has a substantially cup-like configuration and wherein the surface of the second strike element contacting the formed end of the rivet is substantially less concave than the rivet die.

4. An apparatus of claim 3, wherein said surface of the second strike element is flat.

5. An apparatus of claim 1, wherein the surface of the second strike element contacting the formed end of the rivet is convex.

6. An apparatus of claim 1, wherein the rivet includes a rivet head and wherein the surface of the second strike element contacting the head of the rivet is pointed.

7. An apparatus of claim 1, wherein the moving means includes a mounting shaft extending approximately parallel to the direction of the movement of the rivet ram and die, the second strike element being mounted on one end thereof, the mounting shaft being supported for longitudinal and rotational movement, the apparatus further including means for selectively rotating the shaft and the second strike element.

8. An apparatus of claim 7, further including a resilient element connected to the mounting shaft near the other end thereof to permit longitudinal movement of the mounting shaft.

9. An apparatus of claim 1, wherein said means for forming and means for moving are located on both sides of the part, operating on opposing ends of the rivet.

10. An apparatus of claim 1, wherein the second strike element is L-shaped and is mounted for rotation, such that in operation, a portion of the second strike element will rotate between the die and the formed end of the rivet.

11. In an apparatus for control of rivet shanking, which includes means for forming a rivet in a part, which in turn includes a rivet ram, a rivet die in alignment with one end of the rivet, and means for driving the rivet ram forward toward the rivet and for withdrawing the rivet ram and the die from the rivet:

a second strike element for producing additional rivet flow following initial formation of a rivet in a part, wherein one surface of the second strike element contacts the rivet and an opposing surface is accessible to the rivet ram and otherwise characterized by an ability to receive a substantial contact from the rivet ram sufficient to produce additional rivet flow, and wherein the second strike element is L-shaped in configuration, the element being mounted for rotation between two positions about one end of the element, such that the second strike element in one position is away from the rivet die, permitting the rivet die to be driven directly against the rivet, while in a second position, the other end of the second strike element is between the rivet and the rivet die such that the second strike element can be driven against the rivet by the rivet ram and the rivet die.

12. Article of claim 11, wherein the second strike element is thin and substantially flat.

13. An article of claim 11, wherein the rivet has a longitudinal axis and wherein the second strike element is mountable for rotation on an axis which is slightly offset from the rivet axis.

* * * * *